US009089188B2

(12) United States Patent
Wear et al.

(10) Patent No.: US 9,089,188 B2
(45) Date of Patent: Jul. 28, 2015

(54) STRAP ASSEMBLY FOR CARRYING A BAG

(75) Inventors: Jeffrey W. Wear, Portland, OR (US); Heather Herron, Portland, OR (US); Lee A. Dexheimer, Portland, OR (US); Christopher H. Pearson, Billings, MT (US)

(73) Assignee: NIKE, Inc., Beaverton, OR (US)

( * ) Notice: Subject to any disclaimer, the term of this patent is extended or adjusted under 35 U.S.C. 154(b) by 330 days.

(21) Appl. No.: 13/475,247

(22) Filed: May 18, 2012

(65) Prior Publication Data

US 2013/0306504 A1 Nov. 21, 2013

(51) Int. Cl.

| | |
|---|---|
| ***A44B 11/18*** | (2006.01) |
| ***A45C 13/30*** | (2006.01) |
| ***A45F 3/12*** | (2006.01) |
| ***A45F 3/14*** | (2006.01) |

(52) U.S. Cl.

CPC ..... *A44B 11/18* (2013.01); *A45C 13/30* (2013.01); *A45F 3/12* (2013.01); *A45F 3/14* (2013.01); *Y10T 24/47* (2015.01); *Y10T 24/4764* (2015.01)

(58) Field of Classification Search

USPC ..... 224/645, 627, 640, 641, 637

See application file for complete search history.

(56) References Cited

U.S. PATENT DOCUMENTS

| | | | | |
|---|---|---|---|---|
| 5,009,349 | A | 4/1991 | Eide et al. | |
| 5,588,940 | A | 12/1996 | Price et al. | |
| 5,630,536 | A | 5/1997 | Bugnaski | |
| D438,705 | S * | 3/2001 | Steurer | D3/327 |
| 6,460,747 | B1 * | 10/2002 | Tuerschmann et al. | 224/645 |
| 6,648,191 | B2 | 11/2003 | Giggleman | |
| 6,915,932 | B1 | 7/2005 | Wolfe | |
| 2002/0088836 | A1 | 7/2002 | Batten et al. | |
| 2004/0195283 | A1 | 10/2004 | Zebraski | |
| 2004/0200866 | A1 | 10/2004 | Walters, Jr. | |
| 2005/0145517 | A1 | 7/2005 | Yang | |
| 2007/0262105 | A1 | 11/2007 | Tan | |
| 2009/0090754 | A1 | 4/2009 | Haberlein | |
| 2009/0095780 | A1 | 4/2009 | Wangeby et al. | |
| 2012/0241341 | A1 * | 9/2012 | Harris et al. | 206/315.3 |

FOREIGN PATENT DOCUMENTS

WO 2012050566 A1 4/2012

OTHER PUBLICATIONS

International Search Report and Written Opinion, issued Jul. 30, 2013, in corresponding International Patent Application No. PCT/US2013/041511.

* cited by examiner

*Primary Examiner* — Tri Mai

(74) *Attorney, Agent, or Firm* — Banner & Witcoff, Ltd.

(57) ABSTRACT

A strap member includes a first primary strap including a first notch formed along its inner edge and a second primary strap includes a second notch formed along its inner edge, the first notch and second notch defining a recess in the strap member. An intersection point positioned within the recess is at an intersection of lines being one of collinear and tangential with portions of the inner edges of the first and second primary straps. An elastic member extends between the first primary strap and the second primary strap.

24 Claims, 7 Drawing Sheets

STRAP ASSEMBLY FOR CARRYING A BAG

FIELD

Aspects of this invention relate generally to a strap assembly for carrying a bag or other shoulder-borne load and, in particular, to a strap assembly having a pair of primary straps and an elastic member connected to the primary straps.

BACKGROUND

A variety of articles, such as bags, incorporate carry straps that assist with carrying the article. Golf bags conventionally include either one strap or two straps that assist the individual with carrying golf equipment. Golf bags with two straps that extend over the user's shoulders provide additional support for the bag, and comfort for the user. Backpacks generally incorporate a pair of straps that are configured to extend over both shoulders of an individual. Other styles of bags may also include a pair of straps that extend over the shoulders of the individual.

Considerations in the design of a strap assembly with a pair of straps relate to comfort and adjustability. In order to enhance the comfort of the straps on the user, compressible materials are often incorporated into the straps in areas that contact the individual, such as the shoulder. The straps may include adjustment members to vary the length of the straps, and optimize the position of the straps on the user. When carrying a bag, the load of the bag may shift, and it is desirable that the strap assembly accommodate such movement. Further, portions of the straps that extend over the shoulders of the user may tend to separate from one another at times, while at other times their lower ends may tend to bunch together.

It would be desirable to provide a strap assembly that reduces or overcomes some or all of the difficulties inherent in prior known devices. Particular advantages of the present invention will be apparent to those skilled in the art, that is, those who are knowledgeable or experienced in this field of technology, in view of the following disclosure of the invention and detailed description of certain embodiments.

SUMMARY

The principles of the invention may be used to provide a strap assembly for carrying a bag or other shoulder-borne load. In accordance with a first aspect, a strap member includes a first primary strap including a first notch formed along an inner edge of the first primary strap. A second primary strap includes a second notch formed along an inner edge of the second primary strap, the first notch and second notch defining a recess in the strap member. An intersection point positioned within the recess is at an intersection of straight lines being one of collinear and tangential with portions of the inner edges of the first and second primary straps. An elastic member extends between the first primary strap and the second primary strap, and optionally may be located within the recess and/or the area defined by the notches.

In accordance with another aspect, a strap assembly for carrying a bag (or other shoulder borne load) includes a strap member having a first primary strap including a first end connected to the bag, a second end connected to the bag (directly or indirectly), an inner edge extending between the first and second ends, and a first notch formed along the inner edge at the first end. A second primary strap includes a first end connected to the first end of the first primary strap and the bag (directly or indirectly), a second end connected to the bag, an inner edge extending between the first and second ends, and a second notch formed along the inner edge at the first end, the first notch and second notch defining a recess in the strap member. An intersection point is positioned within the recess and is at an intersection of a straight first line being one of collinear and tangential with a portion of the inner edge of the first primary strap and a straight second line being one of collinear and tangential with a portion of the inner edge of the second primary strap. An elastic member has a first end connected to the first primary strap and a second end connected to the second primary strap.

In accordance with a further aspect, a strap assembly includes a base portion having a recess formed therein and a first primary strap extending outwardly from the base portion. The first primary strap includes a first end and a second end opposite the first end, with a first notch being formed in its first end. A second primary strap also extends outwardly from the base portion. This second primary strap includes a first end and a second end opposite the first end, with a second notch being formed in its first end. The first and second notches define at least a portion of the recess in the base portion. An elastic member has a first end connected to the first primary strap and a second end connected to the second primary strap and optionally extends across the recess. An intersection point is positioned within the recess and is at an intersection of a first straight line being one of collinear and tangential with a portion of an inner edge of the first primary strap and a second straight line being one of collinear and tangential with a portion of an inner edge of the second primary strap. The intersection point may be located within the recess and on or below the elastic member.

By providing a strap assembly with first and second primary straps, an elastic member extending between the primary straps, a recess, and an intersection point in the recess, according to certain embodiments, bunching of the primary straps can be reduced, and fit and support of a bag (or other shoulder-borne load) carried by the strap assembly can be improved. These and additional features and advantages disclosed here will be further understood from the following detailed disclosure of certain embodiments.

Figure 1:
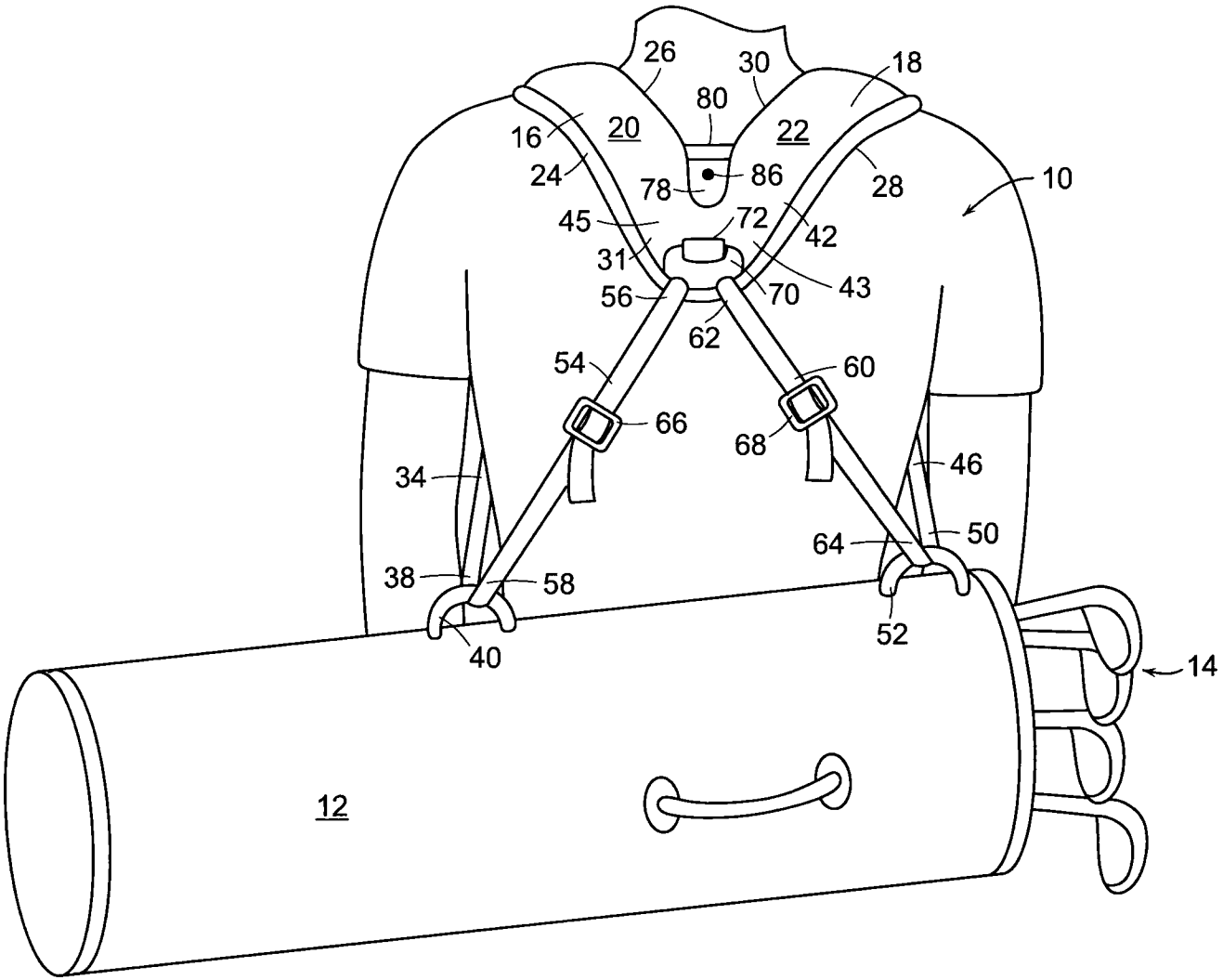
FIG. 1 is a perspective view of a strap assembly in use on a golf bag carried by a user.

The figures referred to above are not drawn necessarily to scale, should be understood to provide a representation of particular embodiments of the invention, and are merely conceptual in nature and illustrative of the principles involved. Some features of the strap assembly depicted in the drawings may have been enlarged or distorted relative to others to facilitate explanation and understanding. The same reference numbers are used in the drawings for similar or identical components and features shown in various alternative embodiments. Strap assemblies as disclosed herein may have configurations and components determined, in part, by the intended application and environment in which they are used.

DETAILED DESCRIPTION OF CERTAIN PREFERRED EMBODIMENTS

The following disclosure and accompanying figures describe strap assemblies that may be secured or connected to bags or other articles and utilized to assist in carrying the bag or article. The strap assemblies are disclosed in combination with golf bags, but concepts associated with the strap assemblies may also be utilized in combination with a wide range of other shoulder-borne loads, including backpacks, briefcases, camera bags, duffel bags, computer bags, handbags, messenger bags, and purses, for example. In addition to bags, concepts associated with strap assemblies in accordance with this invention may be utilized in combination with a variety of other articles, including photographic equipment (i.e., cameras), binoculars, and various types of athletic equipment. An individual skilled in the relevant art will appreciate, therefore, that the concepts disclosed herein apply to strap assembly configurations that are suitable for use with a variety of articles and for a wide variety of purposes.

Figure 2:
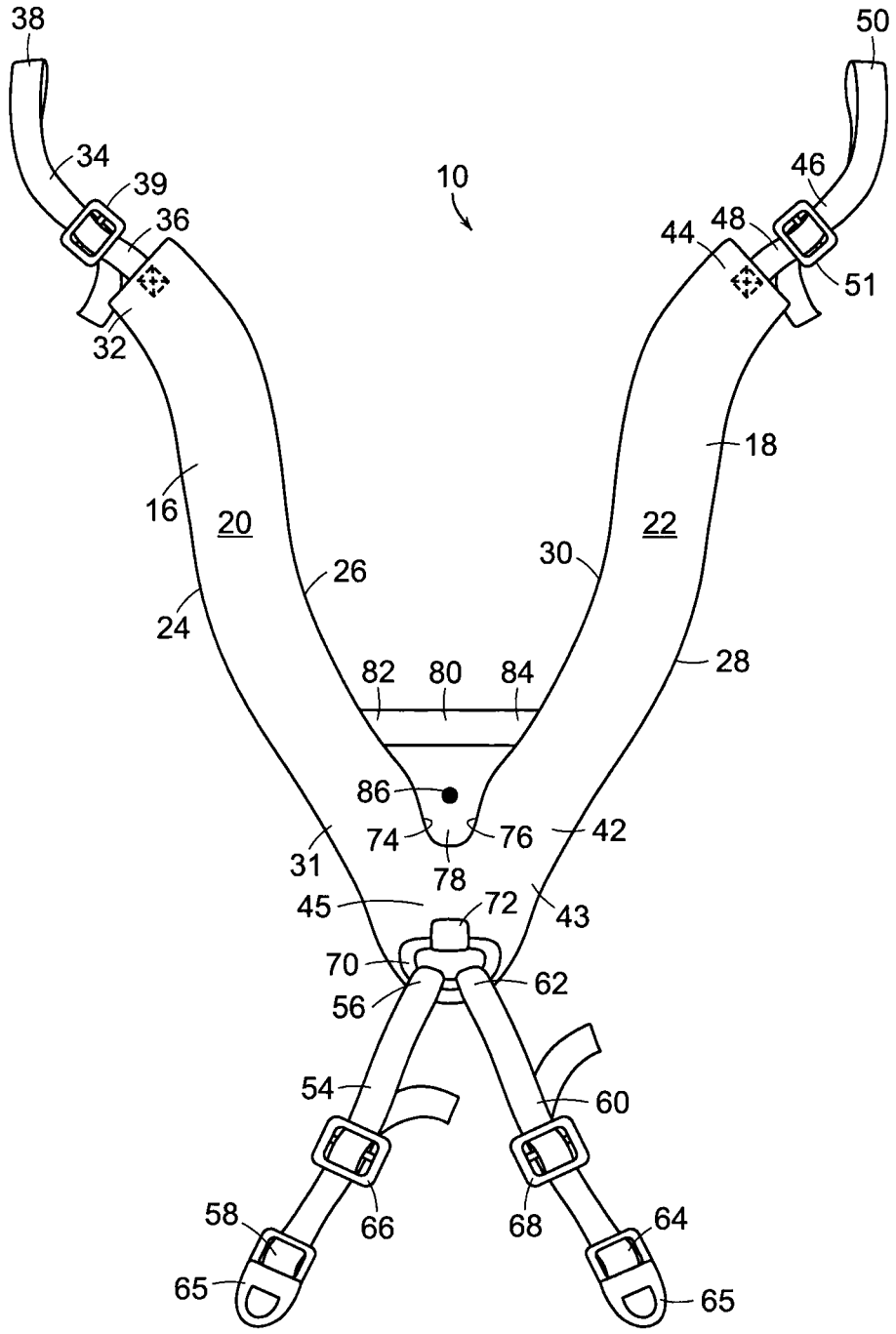
FIG. 2 is a plan view of the strap assembly of FIG. 1.

An embodiment of a strap assembly 10 for use with a golf bag 12 is shown in FIGS. 1-2. Golf bag 12 is designed to carry golf clubs 14 and has a generally conventional configuration that is substantially hollow to accommodate clubs 14. Strap assembly 10 includes a first primary strap 16 and a second primary strap 18, each of which is designed to extend over the shoulder of an individual, or user, thereby permitting the user to carry golf bag 12 and clubs 14.

In such a configuration, each of first primary strap 16 and second primary strap 18 has an interior surface (not visible) that contacts the user's shoulder and back. First primary strap 16 has an opposed exterior surface 20 and second primary strap 18 has an opposed exterior surface 22, each of which faces outwardly away from the user's shoulder and back.

First primary strap 16 has an outer edge 24 extending between its interior surface and exterior surface 20, and an opposed inner edge 26 extending between its interior surface and exterior surface 20. Outer edge 24 faces the user's side (the user's left side in the illustrated embodiment) while inner edge 26 faces the user's neck and middle of the back when strap assembly 10 is worn by the user carrying golf bag 12.

Similarly, second primary strap 18 has an outer edge 28 extending between its interior surface and exterior surface 22, and an opposed inner edge 30 extending between its interior surface and exterior surface 22. Outer edge 28 faces the user's side (the user's right side in the illustrated embodiment) while inner edge 30 faces the user's neck and middle of the back when strap assembly 10 is worn by the user carrying golf bag 12. The inner edges 26 and 28 of primary straps 16 and 18, respectively, face one another when the strap assembly 10 is in use.

First primary strap 16 has a first end 31 and a second end 32, each of which is secured or connected (directly or indirectly) to golf bag 12. In the illustrated embodiment, a first connecting strap 34 has a first end 36 secured to second end 32 of first primary strap 16 by stitching or other suitable means, and a second end 38 secured or connected to golf bag 12. First connecting strap 34 may include an adjustment member 39, such as a strap adjuster, slide, cam buckle, side release buckle, or the like, allowing for adjustment of the length of first connecting strap 34.

In certain embodiments, second end 38 of first connecting strap 34 may be directly secured to a first connecting member 40 on golf bag 12, such as a D-ring or any other suitable connecting member. It is to be appreciated that second end 38 may be releasably secured to first connecting member 40.

Second primary strap 18 has a first end 42 connected to first end 31 of first primary strap 16. As can be seen in FIG. 2, first primary strap 16 and second primary strap 18 cooperate to define a strap member 43. It is to be appreciated that strap member 43 may be substantially V-shaped or substantially U-shaped, depending on the configuration of first and second primary straps 16, 18. First end 31 of first primary strap 16 and first end 42 of second primary strap 18 combine to form a base portion 45 of strap member 43, with the remainder of first primary strap 16 and second primary strap 18 extending outwardly forming the arms of the substantially V-shaped or U-shaped strap member 43.

It is to be appreciated that first primary strap 16 and second primary strap 18 may be separate elements secured to one another by stitching or other suitable fastening means to form strap member 43. In other embodiments, however, first primary strap 16 and second primary strap 18 may be of unitary, that is, one-piece, construction such that strap member 43 is manufactured as a single unitary member.

A second end 44 of second primary strap 18 is secured or connected to golf bag 12. In the illustrated embodiment, a second connecting strap 46 has a first end 48 secured to second end 44 of first primary strap 16 by stitching or other suitable means, and a second end 50 secured or connected to golf bag 12. Second connecting strap 46 may include an adjustment member 51, such as a strap adjuster, slide, cam buckle, side release buckle, or the like allowing for adjustment of the length of second connecting strap 46.

In certain embodiments, second end 50 may be directly secured to a second connecting member 52 on golf bag 12, such as a D-ring or any other suitable connecting member. It is to be appreciated that second end 50 may be releasably secured to second connecting member 52.

A first anchoring strap 54 has a first end 56 secured or connected to first end 31 of first primary strap 16 and/or to base portion 45, and a second end 58 secured or connected to first connecting member 40. A second anchoring strap 60 has a first end 62 secured or connected to first end 42 of second primary strap 18 and/or to base portion 45, and a second end 64 secured or connected to second connecting member 52. In certain embodiments first and second anchoring straps 54, 60 are releasably secured to first and second connecting members 40, 52, respectively with releasable connectors 65. Alternatively, if desired, anchoring straps 54 and 60 may be engaged with connecting members on the golf bag 12 different from connecting members 40, 52 that engage connecting straps 34, 46.

In certain embodiments, the length of first anchoring strap 54 can be adjusted by way of an adjustment member 66, such as a strap adjuster, slide, cam buckle, or side release buckle, for example. Similarly, the length of second anchoring strap 60 can be adjusted by way of an adjustment member 68, such as a strap adjuster, slide, cam buckle, or side release buckle, for example. Other suitable adjustment members will become readily apparent to those skilled in the art, given the benefit of this disclosure.

Adjustment members 39, 51, 66 and 68 help the user to customize the fit of strap assembly 10 and golf bag 12. When first and second connecting members 40, 52 are D-rings, first and second anchoring straps 54, 60 may be looped around each of first and second connecting members 40, 52, respectively, thereby releasably securing first and second anchoring straps 54, 60 to golf bag 12.

In certain embodiments, connecting straps 34, 46 and anchoring straps 54, 60 can be formed of webbing. Suitable materials for such webbing include, but are not limited to, polyester, polypropylene, and nylon. Other suitable materials will become readily apparent to those skilled in the art, given the benefit of this disclosure.

Figure 3:
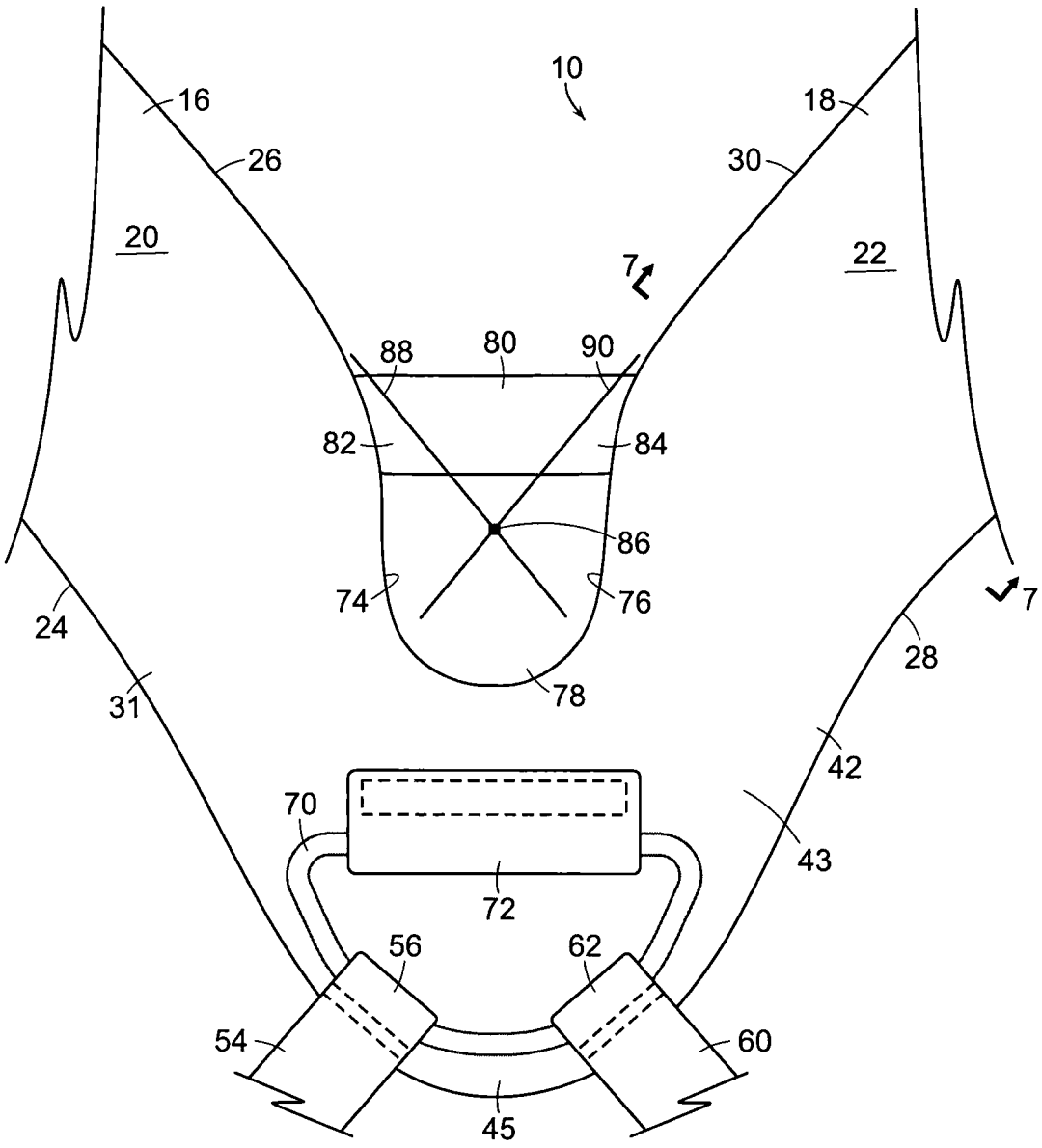
FIG. 3 is an elevation view, shown partially broken-away, of the strap assembly of FIG. 2.

As seen in greater detail in FIG. 3, first end 56 of first anchoring strap 54 and first end 62 of second anchoring strap 60 are secured to strap member 43 by way of an anchoring member 70. In the illustrated embodiment, anchoring member 70 is a D-ring, with first end 56 and first end 62 of anchoring straps 54, 60, respectively, looped around and movable along D-ring. Allowing first ends 56, 62 of first and second anchoring straps 54, 60, respectively, to move along anchoring member 70 allows the weight of bag 12 to pivot and self-adjust as the user walks, thereby increasing comfort for the user and improving performance of strap assembly 10. Additionally, such movement along anchoring member 70 provides flexibility for strap assembly 10, thereby allowing the user to further customize the fit of strap assembly 10 when used to carry bag 12.

In certain embodiments, first end 56 is looped around D-ring 70 and fastened to the remainder of first anchoring strap 54 with stitching. Similarly, first end 62 is looped around D-ring 70 and fastened to the remainder of second anchoring strap 60 with stitching.

A portion of anchoring member 70 may extend through a sleeve 72, which is secured to strap member 43 with stitching or other suitable fastening means. In certain embodiments, such as the D-ring embodiment of anchoring member 70 illustrated here, anchoring member 70 may freely pivot within sleeve 72, and sleeve 72 may move with respect to strap member 43, such that anchoring member 70 also freely moves with respect to strap member 43, providing further flexibility and customization for strap assembly 10.

A first notch 74 is formed on inner edge 26 of first primary strap 16 at first end 31. A second notch 76 is formed on inner edge 30 of second primary strap 18 at first end 42. First notch 74 and second notch 76 combine to form a recess 78 in base portion 45. Providing first and second notches 74, 76 so as to form recess 78 reduces the tendency of first primary strap 16 and second primary strap 18 of strap member 43 to bunch at their first ends 31, 42, respectively, when strap assembly 10 is used to carry bag 12.

An elastic member 80 extends between first primary strap 16 and second primary strap 18. A first end 82 of elastic member 80 is secured to first end 31 of first primary strap 16 by stitching or other suitable fastening means. A second end 84 of elastic member 80 is secured to first end 42 of second primary strap 18 by stitching or other suitable fastening means.

Elastic member 80 is constructed of a material that is elastic enough to stretch upon the application of a tensile force, and be restored to its original shape when the tension upon elastic member 80 is removed. Elastic member 80 may be an elastic strap or a length of elastic webbing, for example. Suitable materials for elastic member 80 include nylon, polypropylene, thermoplastic polyurethane, and polyester. Other suitable materials for elastic member 80 will become readily apparent to those skilled in the art, given the benefit of this disclosure.

Elastic member serves to bias first primary strap 16 and second primary strap 18 to one another, thereby ensuring that they do not separate too much as the load of bag 12 shifts.

As seen most clearly in FIG. 3, an intersection point 86 is positioned within first and second notches 74, 76 and recess 78 of strap member 43. Intersection point 86 is located at an intersection of a straight first line 88 extending along at least a portion of inner edge 26 of first primary strap 16 and a straight second line 90 extending along at least a portion of inner edge 30 of second primary strap 18. This intersection point 86 also may be considered a "phantom" point because it is located in the open area of recess 78 and notches 74, 76 and is not located on a physical intersection of the physical materials of the primary strap inner edges 26, 30. Rather, intersection point 86 is spaced from both first and second primary straps 16, 18.

In the illustrated embodiment, inner edge 26 of first primary strap 16 and inner edge 30 of second primary strap 18 are straight along a portion of their length extending away from first notch 74 and second notch 76, respectively. Thus, as illustrated in this embodiment, first line 88 is collinear with a straight portion of inner edge 26 that extends outwardly from first notch 74 away from first end 31 of first primary strap 16. Similarly, second line 90 extends along a straight portion of inner edge 30 that extends outwardly from second notch 76 away from first end 42 of second primary strap 18.

It is to be appreciated that in certain embodiments, each of inner edge 26 and inner edge 30 may be straight along their entire length, while in other embodiments they may be straight only along only a portion of their length with a remainder of their length being curved (as seen in FIG. 2), and in other embodiments they may be curved along their entire length.

It is to be appreciated that in certain embodiments, where inner edge 26 and inner edge 30 are curved along their entire length, first line 88 and second line 90 will extend tangentially along a portion of inner edge 26 and inner edge 30, respectively.

Consequently, straight first line 88 is one of collinear with and tangential with a portion of inner edge 26, and straight second line 90 is one of collinear with and tangential with a portion of inner edge 30.

Figure 4:
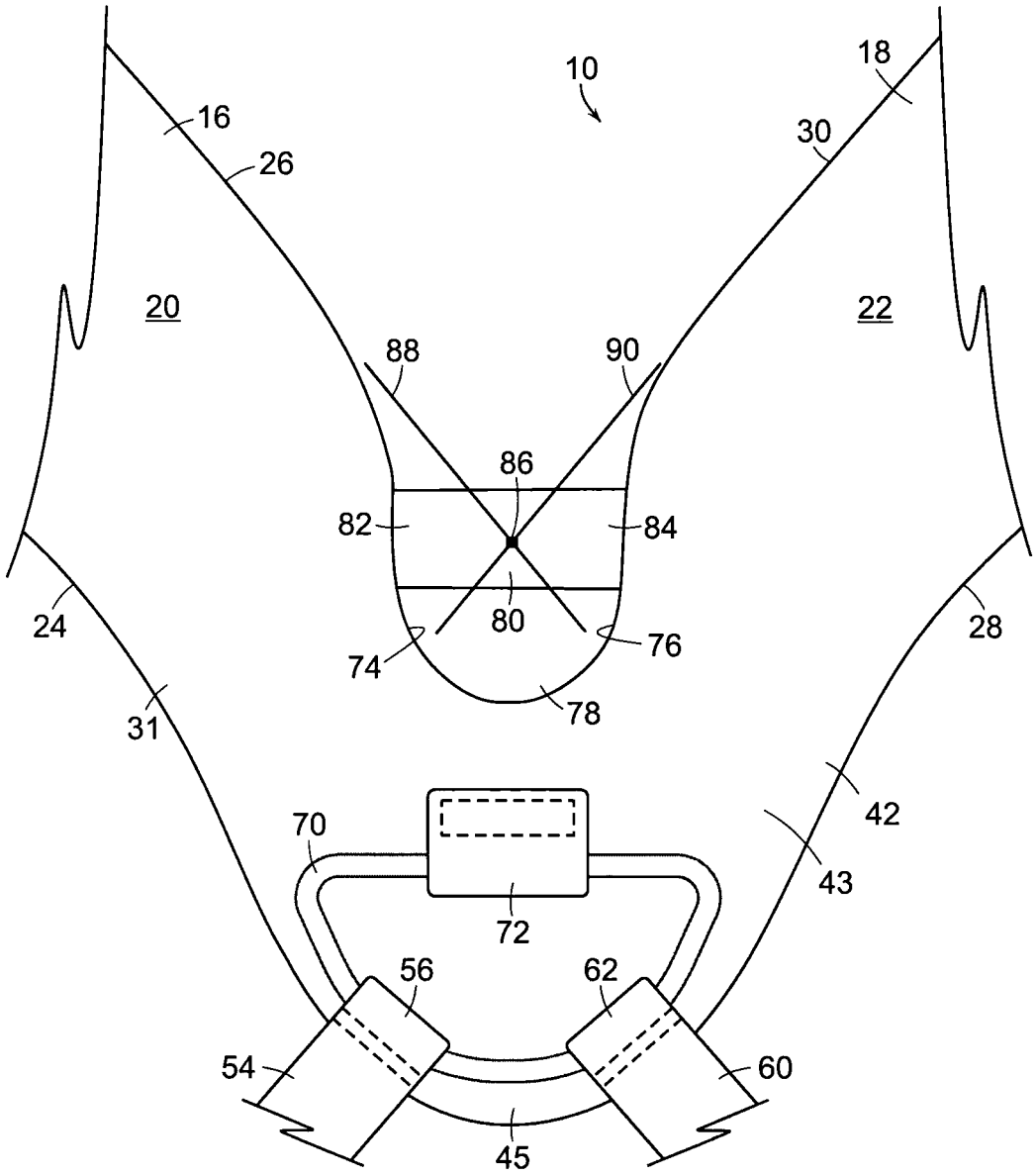
FIG. 4 is an elevation view, shown partially broken-away, of an alternative embodiment of the strap assembly of FIG. 2.

In the embodiment illustrated in FIG. 3, elastic member 80 is positioned proximate the top edge of first notch 74 and second notch 76 and above intersection point 86. In other embodiments, as illustrated in FIG. 4, elastic member 80 may be positioned such that it overlaps with intersection point 86. It is to be appreciated that elastic member 80 can be positioned at any desired location, including below intersection point 86, as well as further outwardly along first and second primary straps 16, 18 away from recess 78 and even above notches 74, 76, if desired.

Figure 5:
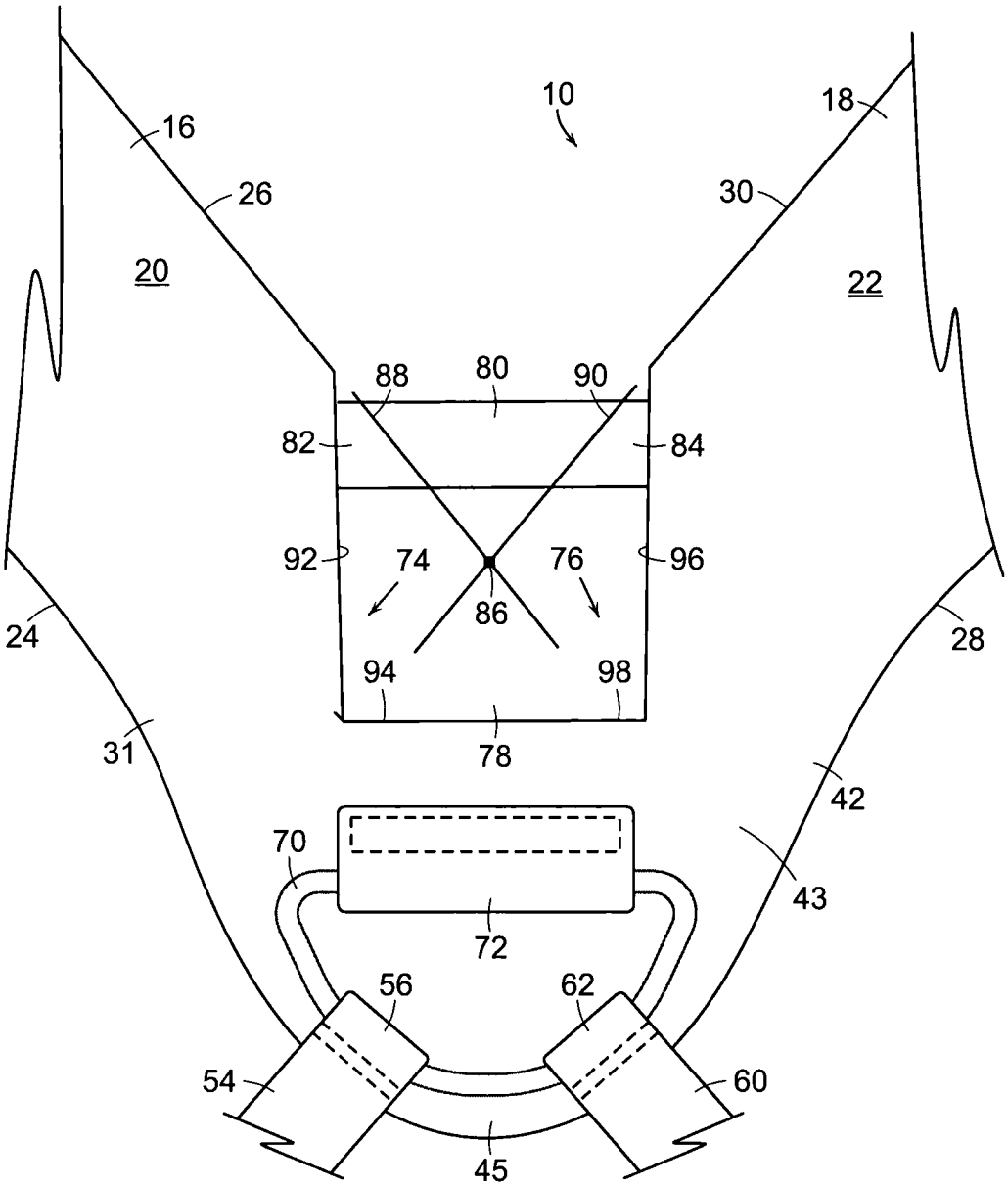
FIG. 5 is an elevation view, shown partially broken-away, of another alternative embodiment of the strap assembly of FIG. 2.

As seen in the embodiment illustrated in FIG. 3, first notch 74 and second notch 76 have curved, or arcuate surfaces so that recess 78 is substantially U-shaped. In other embodiments, as illustrated in FIG. 5, first notch 74 could be formed with a first planar or linear surface 92 extending at an angle from inner edge 26 toward a center of first primary strap 16, and a second planar or linear surface 94, extending substantially perpendicular to first linear surface 92 and inwardly toward the center of strap member 43. Similarly, second notch 76 could be formed with a first linear surface 96 extending at an angle from inner edge 30 toward a center of second primary strap 18, and a second linear surface 98, extending substantially perpendicular to first linear surface 96 and extending substantially collinear with second linear surface 94. Consequently, in such an embodiment recess 78 would have a generally square or rectangular shape defined by planar or linear sidewalls formed by first linear surfaces 92, 96, and a planar or linear bottom formed by the combination of collinear second linear surfaces 94, 98.

Figure 6:
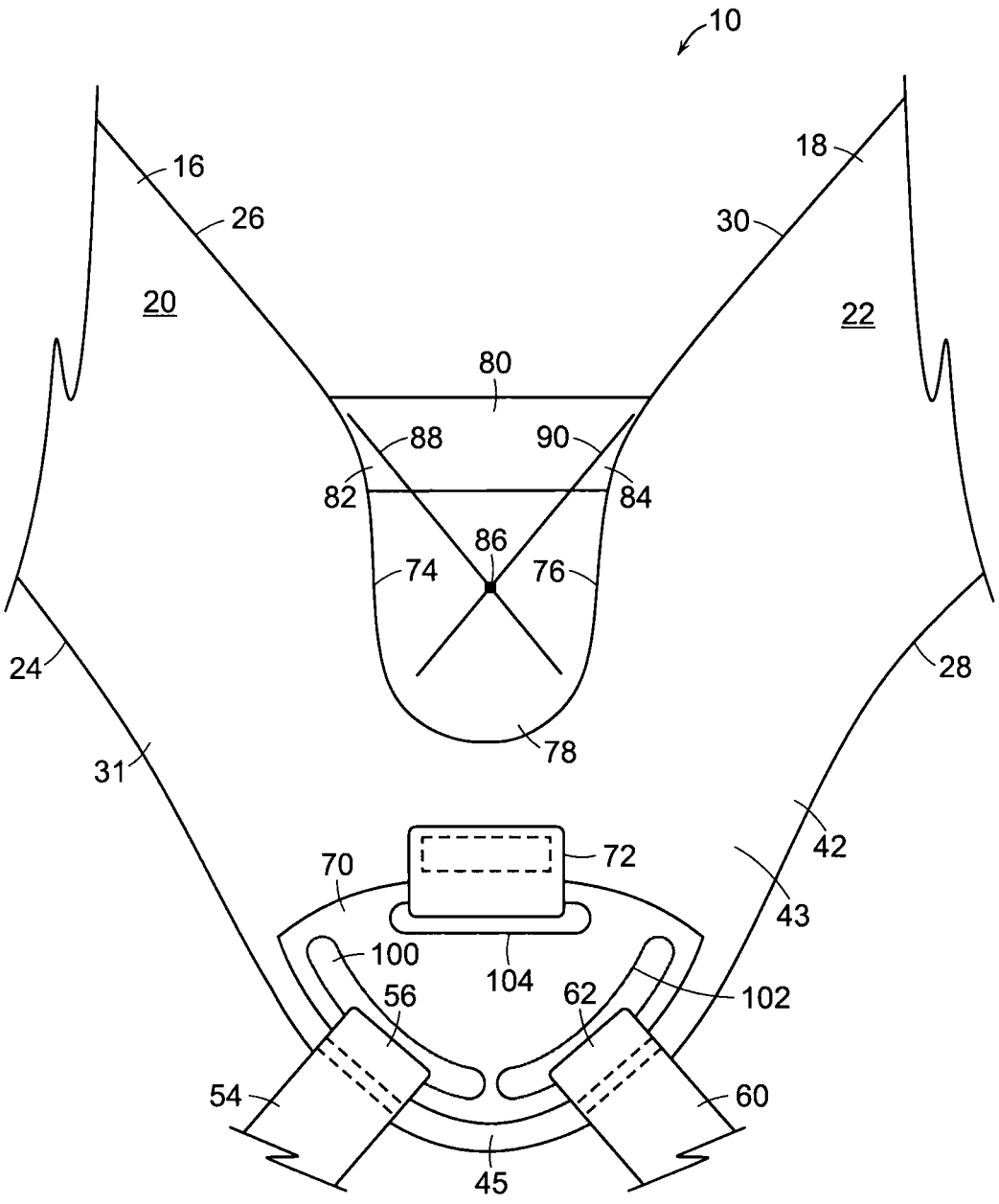
FIG. 6 is an elevation view, shown partially broken-away, of a further alternative embodiment of the strap assembly of FIG. 2.

As noted above, in embodiments where anchoring member 70 is a D-ring, first ends 56, 62 of first and second anchoring straps 54, 60, respectively, can easily move along anchoring member 70, allow the weight of bag 12 to pivot and self-adjust as the user walks. It is to be appreciated that anchoring member 70 can take other forms as well. For example, as illustrated in FIG. 6, anchoring member 70 is a plate having a first slot 100 formed therein, along which first end 56 of first anchoring strap 54 is free to move. A second slot 102 is formed in the plate, along which first end 62 of second anchoring member 60 is free to move. It is to be appreciated that first and second slots 100, 102 may be arcuate slots, as illustrated here, or they may have a straight, linear form. A third slot 104 also may be formed in the plate, with sleeve 72 extending through third slot 104, allowing anchoring member 70 to freely pivot with respect to strap member 43.

Figure 7:
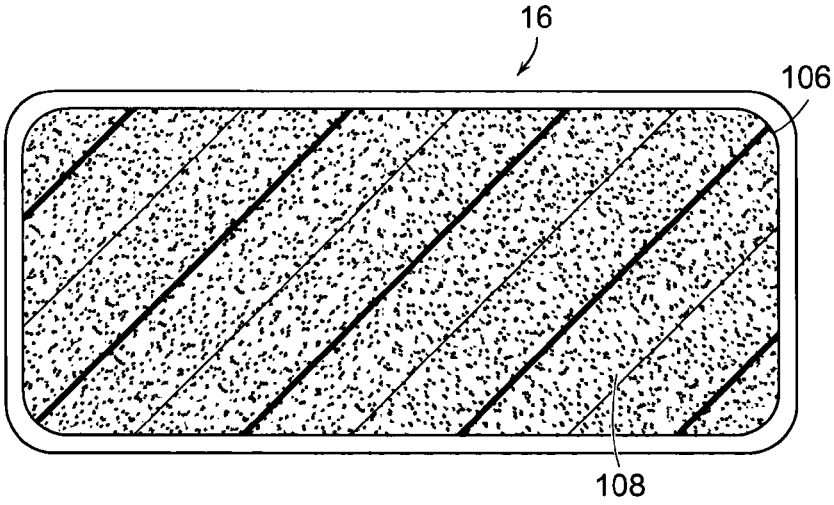
FIG. 7 is a section view of a strap of the strap assembly, taken along line 7-7 of FIG. 3.

In certain embodiments, first and second primary straps 16, 18 are padded, and may include a cover 106 and a soft inner core 108, as illustrated in FIG. 7 with respect to first primary strap 16. Cover 106 may be formed of nylon, polyester, or polypropylene, for example. Inner core 108 may be a foam material or other suitable material that provides cushioning for the shoulders of the user. Conventional foam and other materials suitable for shoulder straps are well known in the art, and further description need not be provided here.

Figure 8:
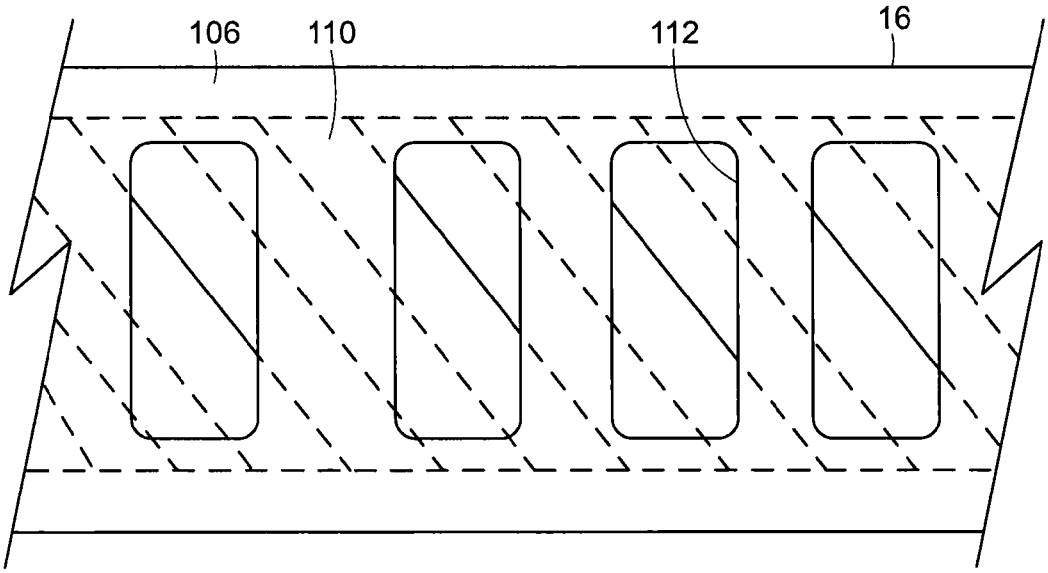
FIG. 8 is a section view of an alternative embodiment of a strap of the strap assembly of FIG. 2.

It is to be appreciated that in certain embodiments, as illustrated in FIG. 8, a fluid-filled bladder 110 may be encased within cover 106 and/or otherwise engaged with first and second primary straps 16, 18. Cover 106 may include one or more windows 112 that expose a portion of fluid-filled bladder 110 to an exterior of first and second primary straps 16, 18. In known fashion, fluid-filled bladder 110 may contain air or any other desired fluid.

A variety of thermoplastic polymer materials may be utilized for bladder 110, including polyurethane, polyester, polyester polyurethane, and polyether polyurethane. Another suitable material for bladder 110 is a film formed from alternating layers of thermoplastic polyurethane and ethylene-vinyl alcohol copolymer, as disclosed in U.S. Pat. Nos. 5,713,141 and 5,952,065 to Mitchell et al., hereby incorporated by reference. A variation upon this material wherein the center layer is formed of ethylene-vinyl alcohol copolymer; the two layers adjacent to the center layer are formed of thermoplastic polyurethane; and the outer layers are formed of a regrind material of thermoplastic polyurethane and ethylene-vinyl alcohol copolymer may also be utilized. Bladder 110 may also be formed from a flexible microlayer membrane that includes alternating layers of a gas barrier material and an elastomeric material, as disclosed in U.S. Pat. Nos. 6,082,025 and 6,127,026 to Bonk et al., both hereby incorporated by reference. In addition, numerous thermoplastic urethanes may be utilized, such as PELLETHANE, a product of the Dow Chemical Company; ELASTOLLAN, a product of the BASF Corporation; and ESTANE, a product of the B.F. Goodrich Company, all of which are either ester or ether based. Still other thermoplastic urethanes based on polyesters, polyethers, polycaprolactone, and polycarbonate macrogels may be employed, and various nitrogen blocking materials may also be utilized. Additional suitable materials are disclosed in U.S. Pat. Nos. 4,183,156 and 4,219,945 to Rudy, hereby incorporated by reference. Further suitable materials include thermoplastic films containing a crystalline material, as disclosed in U.S. Pat. Nos. 4,936,029 and 5,042,176 to Rudy, hereby incorporated by reference, and polyurethane including a polyester polyol, as disclosed in U.S. Pat. Nos. 6,013,340; 6,203,868; and 6,321,465 to Bonk et al., also hereby incorporated by reference.

Thus, while there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. A strap assembly comprising:

a strap member including:

a first primary strap including a first end, a second end, an inner edge extending between the first and second ends, and a first notch formed along the inner edge at the first end; and a second primary strap including a first end connected to the first end of the first primary strap, a second end, an inner edge extending between the first and second ends, and a second notch formed along the inner edge at the first end, the first notch and second notch defining a recess in the strap member, the first primary strap and the second primary strap being of unitary construction such that the strap member is a single unitary member;

an intersection point positioned within the recess and being at an intersection of a straight first line being one of collinear and tangential with a portion of the inner edge of the first primary strap and a straight second line being one of collinear and tangential with a portion of the inner edge of the second primary strap; and an elastic member having a first end connected to the first primary strap and a second end connected to the second primary strap.

2. The strap assembly of claim 1, wherein the first and second ends of the first and second primary straps are configured to be connected to a bag to be carried by the strap assembly.

3. The strap assembly of claim 1, wherein the elastic member overlaps with the intersection point.

4. The strap assembly of claim 1, further comprising:

an anchoring member connected to the first end of the first primary strap and the first end of the second primary strap;

a first anchoring strap connected to the anchoring member; and a second anchoring strap connected to the anchoring member.

5. The strap assembly of claim 4, wherein the first and second anchoring straps are slidably connected to the anchoring member.

6. The strap assembly of claim 4, wherein the anchoring member includes a first slot extending therethrough and a second slot extending therethrough, a portion of the first anchoring strap extending through the first slot and a portion of the second anchoring strap extending through the second slot.

7. The strap assembly of claim 6, wherein the first and second slots are arcuate slots.

8. The strap assembly of claim 4, wherein the first anchoring member is a D ring, the first and second anchoring straps slidably secured along the D ring.

9. The strap assembly of claim 4, wherein the first and second anchoring straps are configured to be connected to a bag to be carried by the strap assembly.

10. The strap assembly of claim 4, further comprising adjustment members positioned along each of the first and second anchoring straps.

11. The strap assembly of claim 1, wherein the first and second primary straps are padded.

12. The strap assembly of claim 1, wherein each of the first and second primary straps include a fluid-filled bladder.

13. The strap assembly of claim 1, wherein the elastic member is an elastic strap.

14. The strap assembly of claim 1, wherein the elastic member is positioned further outwardly along the first and second primary straps from their first ends than the intersection point.

15. The strap assembly of claim 1, further comprising a first connecting strap connected to the second end of the first primary strap and a second connecting strap connected to the second end of the second primary strap.

16. The strap assembly of claim 15, further comprising adjustment members positioned along each of the first and second connecting straps.

17. A shoulder-borne bag comprising:

a bag component defining an interior chamber for holding one or more objects to be carried;

a strap member including:

a first primary strap including a first end connected to the bag component, a second end connected to the bag component, an inner edge extending between the first and second ends, and a first notch formed along the inner edge at the first end; and a second primary strap including a first end connected to the first end of the first primary strap and the bag component, a second end connected to the bag component, an inner edge extending between the first and second ends, and a second notch formed along the inner edge at the first end, the first notch and second notch defining a recess in the strap member, the first primary strap and the second primary strap being of unitary construction such that the strap member is a single unitary member;

an intersection point positioned within the recess and being at an intersection of a straight first line being one of collinear and tangential with a portion of the inner edge of the first primary strap and a straight second line being one of collinear and tangential with a portion of the inner edge of the second primary strap; and an elastic member having a first end connected to the first primary strap and a second end connected to the second primary strap.

18. The shoulder-borne bag of claim 17, further comprising:

an anchoring member connected to the first end of the first primary strap and the first end of the second primary strap;

a first anchoring strap having a first end slidably connected to the anchoring member and a second end engaged with the bag component; and a second anchoring strap having a first end slidably connected to the anchoring member and a second end engaged with the bag component.

19. The shoulder-borne bag of claim 18, further comprising a first connecting strap connected to the second end of the first primary strap and a second connecting strap connected to the second end of the second primary strap, wherein each of the first connecting strap and the second connecting strap are engaged with the bag component.

20. The shoulder-borne bag of claim 19, further comprising adjustment members positioned along each of the first and second anchoring straps and the first and second connecting straps.

21. A strap assembly comprising:

a base portion having a recess formed therein;

a first primary strap extending outwardly from the base portion from a first end to a second end thereof, a first notch being formed in its first end;

a second primary strap extending outwardly from the base portion from a first end to a second end thereof, a second notch being formed in its first end, the first and second notches defining at least a portion of the recess, the first primary strap and the second primary strap being of unitary construction such they form a single unitary strap member; and an elastic member having a first end connected to the first primary strap and a second end connected to the second primary strap; and an intersection point positioned within the recess and being at an intersection of a straight first line being one of collinear and tangential with a portion of the inner edge of the first primary strap and a straight second line being one of collinear and tangential with a portion of the inner edge of the second primary strap.

22. The strap assembly of claim 21, further comprising:

an anchoring member connected to the first end of the first primary strap and the first end of the second primary strap;

a first anchoring strap slidably connected to the anchoring member; and a second anchoring strap slidably connected to the anchoring member.

23. The strap assembly of claim 22, further comprising a first connecting strap connected to the second end of the first primary strap and a second connecting strap connected to the second end of the second primary strap.

24. The strap assembly of claim 23, further comprising adjustment members positioned along each of the first and second anchoring straps and the first and second connecting straps.

* * * * *